US006854800B2

(12) United States Patent
Perego

(10) Patent No.: US 6,854,800 B2
(45) Date of Patent: Feb. 15, 2005

(54) ROCKING HIGH-CHAIR FOR CHILDREN

(75) Inventor: Gianluca Perego, Arcore (IT)

(73) Assignee: PEG Perego S.p.A., Arcore (IT)

( * ) Notice: Subject to any disclaimer, the term of this patent is extended or adjusted under 35 U.S.C. 154(b) by 0 days.

(21) Appl. No.: 10/634,556

(22) Filed: Aug. 5, 2003

(65) Prior Publication Data

US 2004/0046427 A1 Mar. 11, 2004

(30) Foreign Application Priority Data

Sep. 6, 2002 (IT) ..... MI2002A1897

(51) Int. Cl.[7] ..... A47C 3/02; A47C 3/027; A47C 3/03; A47C 13/00; A47C 1/08

(52) U.S. Cl. ..... 297/148; 297/131; 297/132; 297/133; 297/149; 297/150; 297/151; 297/153; 297/154; 297/32; 297/33; 297/258.1; 297/260.1; 297/270.1; 297/270.5; 297/271.1; 297/271.5; 297/271.6

(58) Field of Search ..... 297/148, 149, 297/150, 151, 153, 154, 260.1, 260.2, 261.1, 270.1, 270.5, 271.1, 271.4, 271.5, 271.6, 272.1, 258.1, 130, 131, 132, 133, 32, 33, 16.1, 16.2

(56) References Cited

U.S. PATENT DOCUMENTS 19,352 A * 2/1858 Currier ..... 297/131
134,668 A * 1/1873 Henrichs ..... 297/131
138,620 A * 5/1873 Downing ..... 297/151 X
146,888 A * 1/1874 Downing ..... 297/149 X
146,889 A * 1/1874 Downing ..... 297/151
202,170 A * 4/1878 Hayman ..... 297/118 X
220,258 A * 10/1879 Stevens ..... 297/131
223,109 A * 12/1879 Brick ..... 297/131
224,923 A * 2/1880 Kenna ..... 297/154 X (List continued on next page.)

FOREIGN PATENT DOCUMENTS

FR 594 242 A 9/1925
FR 935 661 A 6/1948
FR 970 435 A 1/1951
GB 2240711 A * 8/1991 ..... 297/154
GB 2 382 523 A 6/2003

*Primary Examiner*—Rodney B. White
(74) *Attorney, Agent, or Firm*—McGlew and Tuttle, P.C.

(57) ABSTRACT

A children's high chair comprises a supporting frame (11, 111) for a high chair (12,112) for receiving the child. The frame (11,111) comprises in turn a pair of legs (14,15) openable compasswise and with lower ends (19,119) for resting on the ground and stiffening crosspieces (20,120) arranged on both sides of the frame and movable between a non-operational position allowing closing of the frame and an operational position in which the crosspieces engage the legs to hold them steadily in open position. The crosspieces (20,120) can be moved to another more lowered operational position to rest on the ground to constitute high chair rocking members. Advantageously an automatic battery-powered mechanical rocking device can be provided.

24 Claims, 4 Drawing Sheets

U.S. PATENT DOCUMENTS 229,061 A * 6/1880 Stevens ..... 297/154 X
379,959 A * 3/1888 Knieper ..... 297/131
394,716 A * 12/1888 Odell ..... 297/131
611,144 A * 9/1898 Plummer ..... 297/118 X
685,509 A * 10/1901 Dutton ..... 297/154 X
736,709 A * 8/1903 Dutton ..... 297/131
745,334 A * 12/1903 Dutton ..... 297/154 X
866,853 A * 9/1907 French ..... 297/154 X
893,289 A * 7/1908 Wanner, Jr. ..... 297/131
907,253 A * 12/1908 Lepard ..... 297/132
912,216 A * 2/1909 Wells ..... 297/131 X
983,768 A * 2/1911 Reisman ..... 297/131
993,733 A * 5/1911 Tann ..... 297/132
1,025,422 A * 5/1912 Peters ..... 297/132
1,026,276 A * 5/1912 Moskowits ..... 297/131
1,421,260 A * 6/1922 Kurnick ..... 297/131
1,445,453 A * 2/1923 Sheller ..... 297/270.5 X
1,471,495 A * 10/1923 Marheine ..... 297/131
1,587,253 A * 6/1926 Tarbox ..... 297/154 X
1,621,930 A * 3/1927 Sew ..... 297/154 X
1,889,646 A * 11/1932 Ermst ..... 208/271.6 X
1,943,037 A * 1/1934 Overbey ..... 297/154 X
2,083,053 A * 6/1937 Collins ..... 297/154
2,284,498 A * 5/1942 Temple ..... 297/154 X
2,407,839 A * 9/1946 Lemos ..... 297/131
2,507,165 A * 5/1950 Kreutzer ..... 297/131
2,535,212 A * 12/1950 Johnson ..... 297/149
2,627,300 A * 2/1953 Stanley et al. ..... 297/154 X
3,137,511 A * 6/1964 Weil et al. ..... 297/118 X
3,269,771 A * 8/1966 Erdos ..... 297/132
3,567,275 A * 3/1971 Bukey ..... 297/133
3,874,725 A * 4/1975 Perry ..... 297/133
4,394,046 A * 7/1983 Irwin et al. ..... 297/132
4,718,715 A * 1/1988 Ho ..... 297/133
4,807,926 A * 2/1989 Brunn ..... 297/33
5,368,361 A 11/1994 Wen-Ming ..... 297/260.2
5,520,433 A * 5/1996 Tokutake et al. ..... 297/131
5,531,502 A * 7/1996 Berggren ..... 297/131
5,560,675 A * 10/1996 Altheimer et al. ..... 297/33
6,089,654 A * 7/2000 Burstein ..... 297/151
6,412,867 B2 * 7/2002 Robinson ..... 297/260.2
6,550,857 B1 * 4/2003 Canton ..... 297/132
2001/0026088 A1 * 10/2001 Robinson ..... 297/260.2
2002/0185895 A1 * 12/2002 Marshall ..... 297/153

* cited by examiner

ROCKING HIGH-CHAIR FOR CHILDREN

BACKGROUND OF THE INVENTION

The present invention relates to an innovative high chair with rocking function.

The general purpose of the present invention is to make available in a simple, economical and stout manner a rocking function, even automatic, for a children's high chair.

SUMMARY OF THE INVENTION

In view of this purpose it was sought to realize in accordance with the present invention a children's high chair comprising a supporting frame for a high chair for receiving the child with the frame comprising a pair of legs openable compasswise and with lower ends for resting on the ground and stiffening crosspieces arranged on both sides of the frame and movable between a non-operational position allowing closing of the frame and an operational position in which the crosspieces engage the legs to hold them steadily in open position characterized in that the crosspieces are equipped with an upper surface designed for ground support and can be moved to another more lowered operational position to rest on the ground with said lower surface for lifting said lower ends from the ground to constitute high chair rocking members.

BRIEF DESCRIPTION OF THE DRAWINGS

To clarify the explanation of the innovative principles of the present invention and its advantages compared with the prior art there is described below with the aid of the annexed drawings a possible embodiment thereof by way of non-limiting example applying said principles. In the drawings.

DETAILED DESCRIPTION OF THE INVENTION

Figure 1:
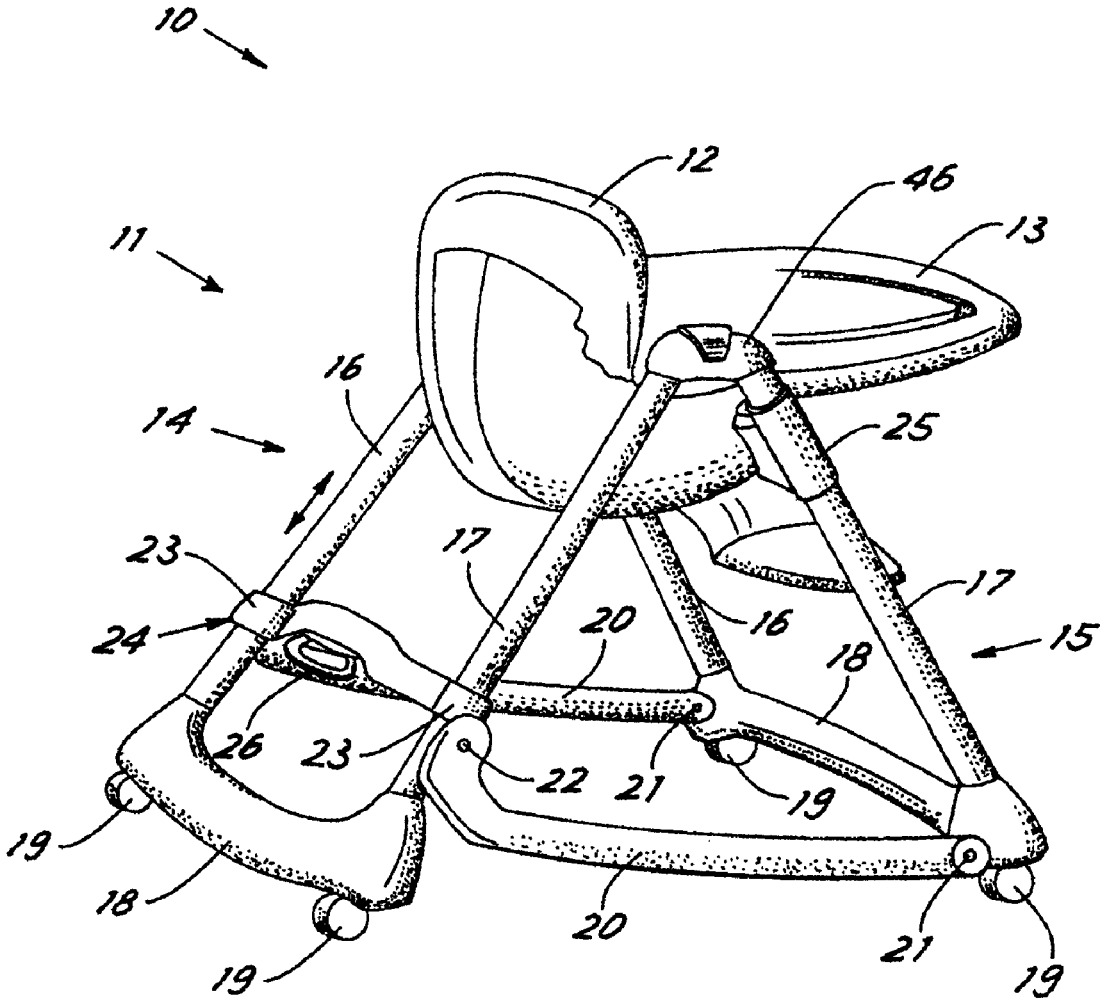
FIG. 1 shows a diagrammatic rear side perspective view of a high chair in accordance with the present invention.

With reference to the figures, FIG. 1 shows designated as a whole by reference number 10 a high chair for children comprising a support frame 11 for a high chair 12 for receiving a child. The high chair may be adjustable in height on the frame and can comprise a front tray 13.

The frame comprises two legs 14, 15 which can be opened compasswise by means of an upper hinging member 46. Each leg is advantageously made up of a pair of parallel tubular members 16, 17 placed on the two sides of the high chair and interconnected below by a connecting crosspiece member 18. The lower ends of the legs are for resting on the ground and can advantageously be equipped with rollers 19.

Figure 2:
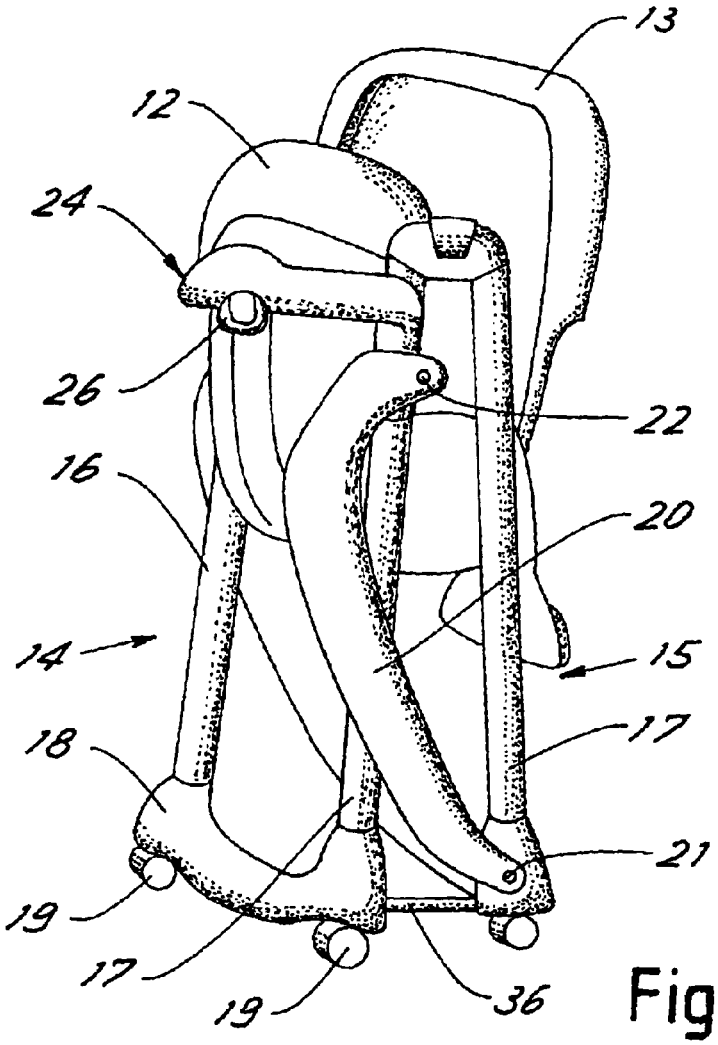
FIG. 2 shows a view in closed position of the high chair of FIG. 1.

On the two sides the frame also comprises stiffening crosspieces 20 which are engaged between the legs to hold the legs rigidly in open position. As may be seen from a comparison of FIGS. 1 and 2 said crosspieces 20 are movable between the operational position of FIG. 1 and the non-operational position of FIG. 2 allowing closing of the frame with approach of the legs.

To move between the operational and non-operational positions the crosspieces 20 have one end hinged at 21 to one leg of the pair to rotate between a raised non-operational and a lowered operational position.

The other end of the crosspieces is advantageously fastened by a pin at 22 to a cursor 23 which runs on the other leg of the pair. Advantageously the hinging leg is the front leg 15 while the running leg of the cursor is the front leg 14.

With the legs formed by two parallel tubular members the cursors of the two crosspieces are mutually interconnected to form a single bar member 24 running along the corresponding leg. The running member is equipped with releasable locking means of running along the leg.

For height adjustment the high chair runs along the corresponding tubular members of the other leg 15 by means of cursors 25 which are also equipped with releasable locking means (not shown).

The crosspieces 20 are shaped with lower surface curved upward and can be moved to another operational position lower than the stiffening operational position of FIG. 1 so as to rest on the ground and constitute shoes for rocking of the high chair. In this further lowered operational position the supporting ends of the legs rise from the ground and the high chair can rock on the shoes consisting of the crosspieces with the supporting ends of the legs constituting alternatively the end of travel of the rocking movement. This is all shown clearly in FIG. 3.

Figure 3:
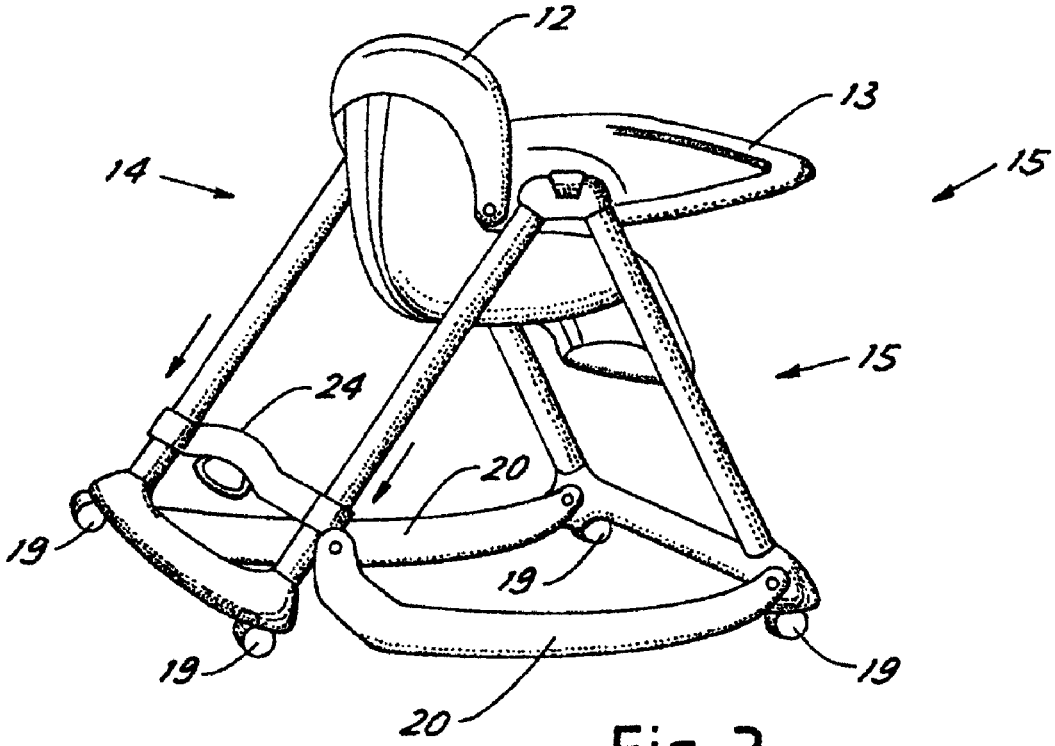
FIG. 3 shows a view similar to that of FIG. 1 but with the high chair in rocking position.

The running member 24 therefore has three releasable locking positions corresponding to the non-operational position (FIG. 2), the operational "high chair" position (FIG. 1) and the additional lower operational rocking position (FIG. 3). In the closed position there can be provided an engagement member 36 between the legs for safe holding in this position, for example during transportation. As may be seen in FIG. 2, the legs and the compasswise hinging can be sized so that the high chair will remain standing even in the closed position.

Figure 4:
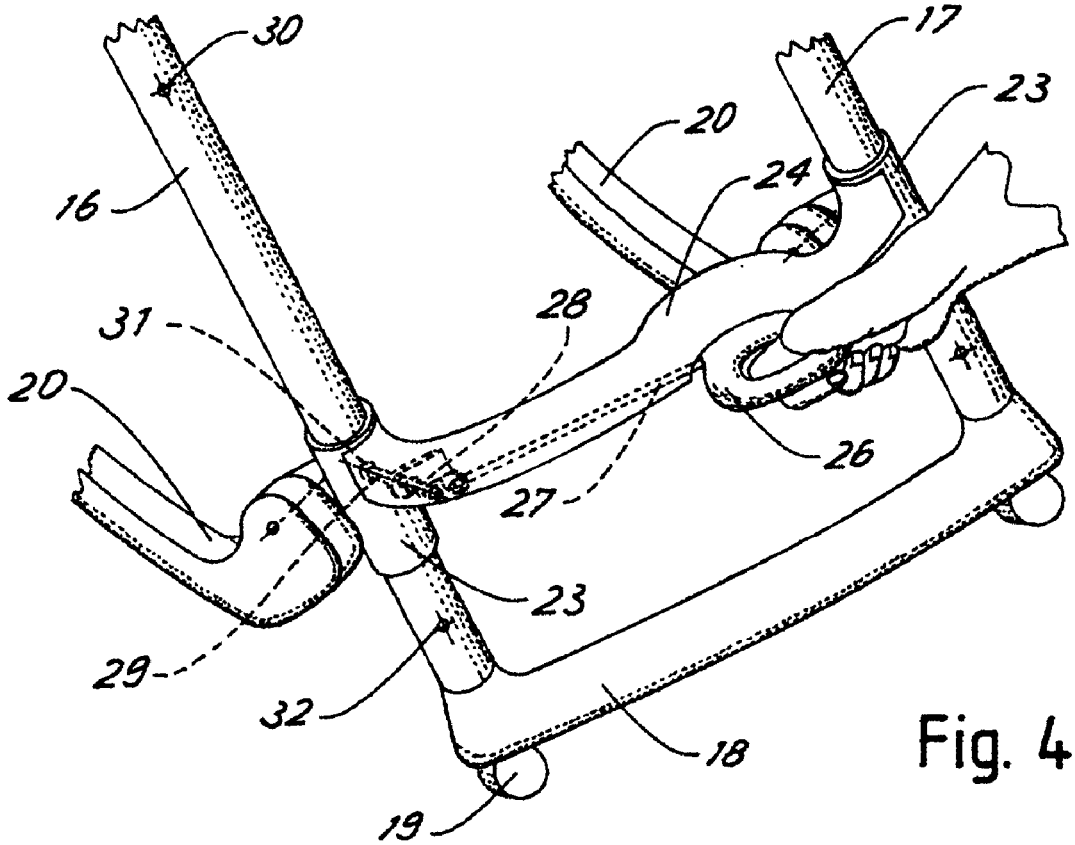
FIG. 4 shows an enlarged partial rear perspective view of a detail of the high chair of FIG. 1.

FIG. 4 shows diagrammatically a possible advantageous realization of the releasable locking means. As may be seen in this figure the locking means comprise a control handle 26 arranged centrally on the running member 24. The handle controls through a transmission 27 the movement (against the action of a spring 28) of locking pins 29 present within the respective cursors 23. The figure shows a single pin with the other being symmetrically equal in the other cursor.

Pushed by the respective spring the pins 29 engage in one of three engagement holes 30, 31, 32 corresponding to the three above mentioned positions of the crosspieces. By pulling the handle 26 upward the pins are withdrawn from the hole and the cursor running member 24 can be move to one of the other engagement positions.

Figure 5:
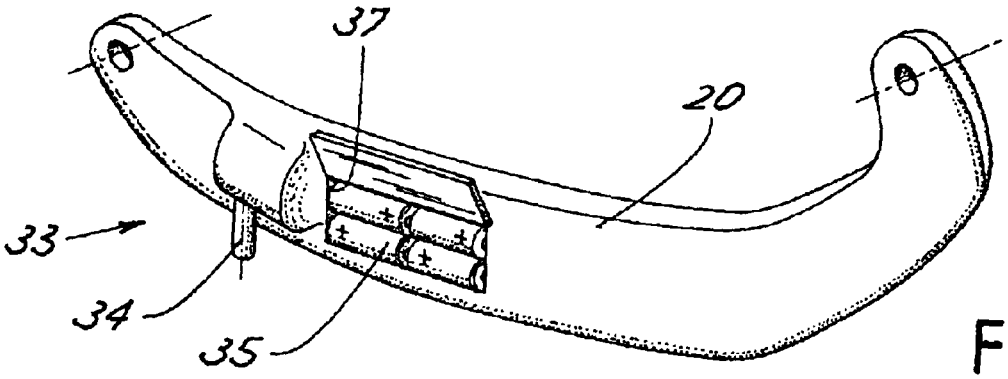
FIG. 5 shows an enlarged partial view of a variant embodiment of another detail of the high chair of FIG. 1, and FIGS. 6 and 7 show diagrammatic views of another embodiment of a high chair in accordance with the present invention.

In accordance with a variant embodiment of the present invention there can also be provided a mechanical rocking device 33 so that the rocking can be automated when required. As may be seen in FIG. 5 this mechanical rocking device (advantageously integrated on one of the two crosspieces 20) comprises a member or pin 34 which is powered (for example by means of a cam) to project rhythmically earthward so as to push on the ground when the crosspieces are in the lowest operational position. The device is powered by batteries 35 which can be contained in a space 37 made in the crosspiece. A switch (not shown) activates the device when desired.

Figure 6:
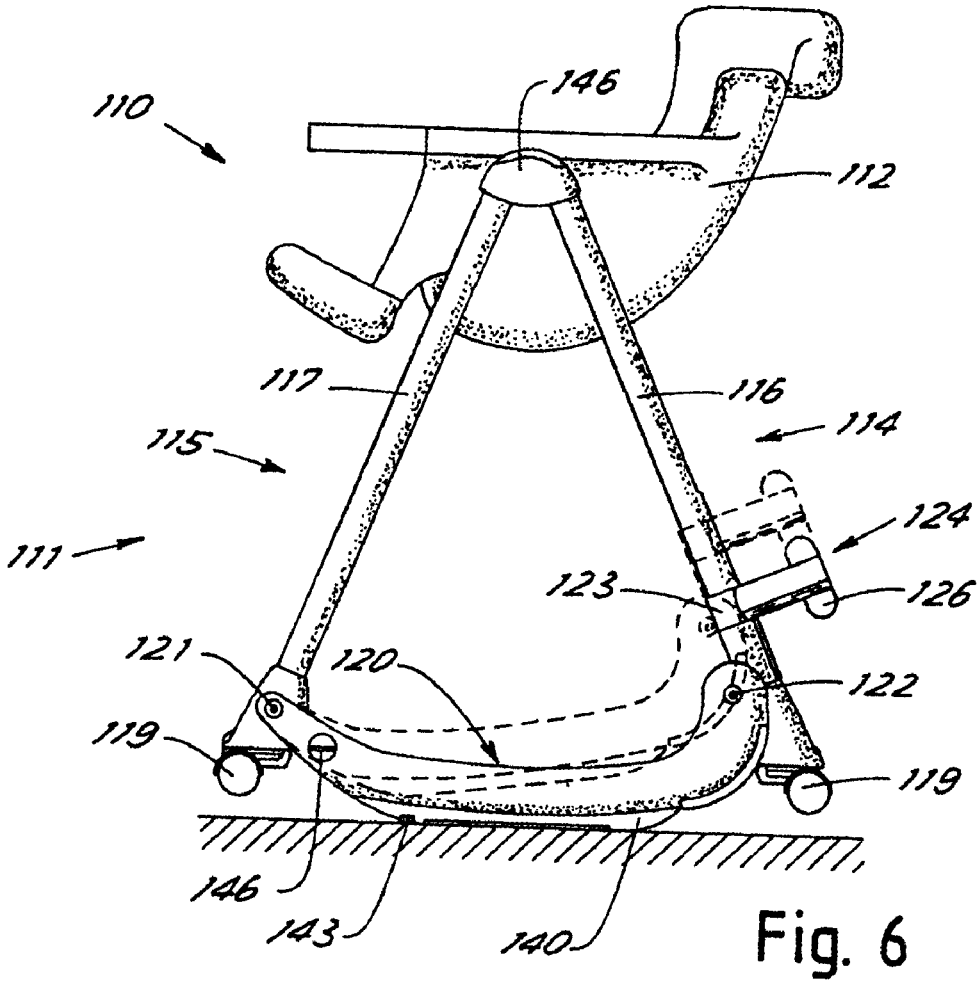

FIG. 6 shows a side view of another embodiment of a high chair in accordance with the present invention. For the sake of simplicity members similar to the above embodiment are designated below by the same number increased by 100.

In its general structure the high chair 110 is similar to the high chair of the above embodiment. There is thus a frame 111 supporting a baby's chair 112 comprising tubular legs 114, 115 formed of tubular members 116, 117 on the two sides of the baby's chair and openable compasswise by means of a hinging 146. The lower ends of the legs are for ground support and can advantageously be equipped with rollers 119.

On both sides the frame also comprises stiffening crosspieces 120 which intervene to engage between the legs to hold the legs rigidly in open position. Similarly to the crosspieces 20 the crosspieces 120 are movable between an operational and a non-operational position allowing closing of the frame with approach of the legs.

For movement between the operational and non-operational positions the crosspieces 120 have one end hinged at 121 to a leg. The other end of the crosspieces is advantageously pinned at 122 to a cursor 123 running on the other leg of the pair. The two cursors are interconnected to form a single bar member 124. A handle 126 allows handling by means of a mechanism similar to the above embodiment and therefore not further shown.

FIG. 6 shows in broken lines the first operational position of the crosspieces 120 while the second and lower operational position is shown in solid lines where the crosspieces 120 touch the ground and raise the leg supporting wheels again similarly to the embodiment of FIG. 1.

The crosspieces 120 have a lower part 140 realized as a separate part to form a ground support member. Differently from the above embodiment the support surface is not curved for rocking support but on the contrary is shaped (flat for example) to provide steady support and is mounted swinging on the remaining crosspiece part.

As may be seen in FIG. 7 where a cross section of a crosspiece is shown, the member 140 is received partially in the crosspiece to protrude below and is hinged centrally at 141 to the interior of the crosspiece. The part 140 is held centered in its swinging movement by an elastic force produced by an elastic member and in particular a leaf spring 142. The force of the spring is chosen to hold the separate support part 140 of the crosspiece centered in its swinging arc, i.e. to hold the high chair virtually vertical on the support consisting of part 140 while at the same time allowing a rocking movement around the pin 141 when a relatively small external force is applied.

Advantageously the top surface 147 of the ground support part is curved and on it rests and rocks an internal surface 148 of the crosspiece so that the weight of the high chair is not all relieved on the pin 141 whose only function is holding the two members centered but is supported by the two surfaces in contact.

The entire high chair can thus swing around the point 141 to have the rocking effect appropriately controlled and limited by alternating contact of the front and rear wheels on the ground.

As the rocking movement takes place between the support part 140 and the rest of the crosspiece and not between the crosspiece and the ground, the force necessary for rocking of the high chair is independent of the type of surface occurring on the ground. This allows for example having rocking without effort even if the high chair is resting on a thick rug or the like.

A screwing adjustment ringnut 143 acts between the ground support part and the rest of the crosspiece and allows inclination of the base with respect to the ground and consequently moving the center of gravity of the whole. This allows optimizing use of the product as a function of the child's weight.

Figure 7:
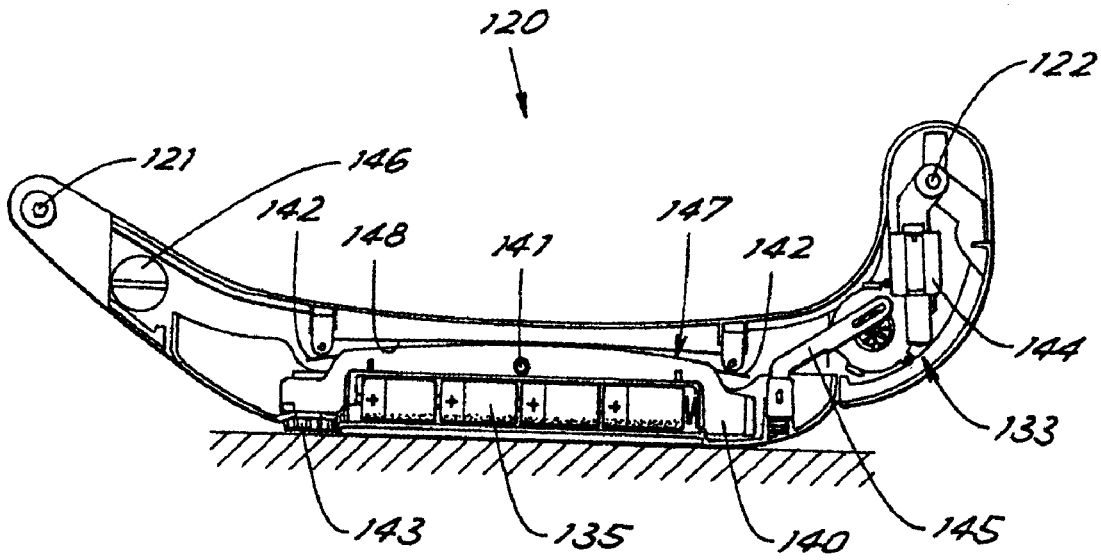

The solution of FIGS. 6 and 7 also allows having a powered movement by means of a control 133. To this end it was found advantageous to fit a gearmotor 144 at one end of the crosspiece made hollow. The gearmotor is powered by batteries 135 contained in a space in the crosspiece and, through a connecting rod 145, transmits rocking motion to the base with respect to the rest of the frame. An interrupter 146 allows operation of the gearmotor.

It is now clear that the predetermined purposes have been achieved by making available a high chair with simple and stout structure in which the stiffening crosspieces are also members allowing easy conversion of the high chair into a safe swing, advantageously with powered rocking also.

Naturally the above description of an embodiment applying the innovative principles of the present invention is given by way of non-limiting example of said principles within the scope of the exclusive right claimed here. For example the aesthetic form, proportions and arrangement of the various parts can vary depending a specific requirements or preferences.

What is claimed is:

1. A children's high chair comprising a supporting frame for a high chair for receiving a child, said frame comprising:

a first and second pair of pivoting legs with lower ends for resting on the ground, each of said pair of legs being movable between an open, use position and a closed, non-use position;

a stiffening crosspiece arranged at each side of the supporting frame and movable between a non-operational position allowing collapsible folding of the supporting frame to the closed, non-use position and an operational position in which said crosspieces enable said pair of legs to be held steadily in the open position, said crosspieces each having a lower surface forming a ground support; and a positioning means connected to each crosspiece for positioning each pair of legs into said closed, non-use position, each crosspiece into said non-operational position and into said operational position, and into a lowered crosspiece position with said lower ends of said legs spaced from the ground to provide a rocker.

2. A children's high chair in accordance with claim 1, wherein said lower surface of said crosspiece is curved to form a rocking shoe.

3. A children's high chair in accordance with claim 1, wherein said lower surface of said crosspiece is fastened on a lower support member being applied on said croaspiece in a rocking manner.

4. A children's high chair in accordance with claim 3, further comprising a ringnut for manual adjustment of the inclination of said lower support member.

5. A children's high chair in accordance with claim 3, wherein said crosspiece rests on said lower support member by of corresponding surfaces with curved contact to allow reciprocating rocking movement.

6. A children's high chair in accordance with claim 3, wherein said lower support member having an upper part protruding to a box-shaped groove in the lower part of said croaspiece.

7. A children's high chair in accordance with claim 3, wherein a powered drive is arranged between the ground support part of said croaspieces and the remaining part of said crosspieces to produce a reciprocating mechanical rocking.

8. A children's high chair in accordance with claim 7, wherein said powered drive comprises a gear motor supported in said crosspiece and acting through a connecting rod on said lower support member.

9. A children's high chair in accordance with claim 3, wherein said lower support member is held centered in a rocking movement by elastic force produced by elastic reaction member.

10. A children's high chair in accordance with claim 9, wherein said elastic reaction members comprise a leaf spring for elastically holding said lower support member in an intermediate position along its rocking arc.

11. A children'high chair in accordance with claim 1, wherein said crosspiece has one end hinged to one of said pair of legs to rotate between a raised non-operational position and said lowered operational position.

12. A children's high chair comprising a supporting frame for a high chair for receiving the child, said supporting frame comprising:

two pairs of legs openable from a closed, non-use position to a open, use position, said teas having lower ends for resting on the ground;

two stiffening crosspieces arranged on both sides of said supporting frame and movable between a non-operational position with said supporting frame in a closed, non-use position and an operational position in which said crosspieces which are equipped with a lower surface designed for ground support can be moved to a further lowered operational position to rest on the ground with said lower surface for lifting said lower ends of said legs from the ground to constitute high chair rocking members, said crosspieces each having one end hinged to a first leg of each of said two pairs of legs to pivot between a raised crosspiece position and a lowered crosspiece position, and each of said crosspieces having another end connected to a running member movable along a second leg of said two pairs of legs.

13. A children's high chair in accordance with claim 12, wherein each pair of said two pairs of legs is made up of two parallel tubular members placed on the two sides of the high chair and interconnected below by a transversal connection member.

14. A children's high chair in accordance with claim 13, wherein the croaspieces are connected to the second legs by corresponding running members of the crosspieces running along corresponding tubular members of said second pair of said two pairs legs.

15. A children's high chair in accordance with claim 14, wherein the high chair runs along corresponding tubular members of said second pair of said two pairs of legs to be adjustable in height.

16. A children's high chair in accordance with claim 14, wherein said running members of said crosspieces are mutually interconnected to form a single running member for running along two corresponding legs that are equipped with releasable looking means for locking said single running member.

17. A children's high chair in accordance with claim 16, wherein said single running member has three releasable locking positions corresponding to the non-operational position, the operational position and the additional further lowered operational position.

18. A children's high chair in accordance with claim 16, wherein said single running member comprises a control handle connected to said releasable locking means for controlling disengagement of locking pins from engagements along said two corresponding legs.

19. A children's high chair in accordance with claim 1, wherein the ground support ends of said two pairs of legs constitute stop members for the rocking movement when the high chair is resting on said crosspieces arranged in their position.

20. A children's high chair in accordance with claim 1, wherein the ends of said two pairs of the ground support legs have wheels.

21. A children's high chair in accordance with claim 1, further comprising a mechanical rocking device connected to each of said crosspieces.

22. A children's high chair in accordance with claim 21, wherein said mechanical rocking device is integrated in said crosspiece and is powered with batteries contained in a space of said crosapiece.

23. A children's high chair in accordance with claim 21, wherein said mechanical rocking device comprises a member which is powered to project rhythmically to the ground.

24. A children's high chair comprising a supporting frame for a high chair for receiving the child, said frame comprising;

a first pair of articulated legs with lower ends for resting on the ground, said first pair of legs being movable between an open, use position and a closed, non-use position;

a second pair of articulated legs with lower ends for resting on the ground, said second pair of legs being movable between an open, use position and a closed, non-use position;

a first stiffening crosspiece arranged at a first side of the frame connecting said first pair of legs;

a second stiffening crosspiece arranged at a second side of the frame connecting said second pair of legs; and a first crosspiece connection means for connecting one end of said first stiffening crosspiece to a leg of said first pair of legs and with another end of said first stiffening crosspiece hinged to another leg of said first pair of legs to position said first pair of legs into the closed, non-use position and said first crosspiece into a non-operational position, said leas into the open, use position to rest respective lower ends of said legs on the grounds and said first crosspiece into an operational rocker position wherein a lower surface of said first stiffening crosspiece rests on the ground to provide the operational rocker position;

a second crosspiece connection means for connecting one end of said second stiffening crosspiece to a leg of said second pair of legs and with another end of said second stiffening crosspiece hinged to another leg of said second pair of legs to position said second pair of legs into the closed, non-use position and said second crosspiece into a closed, non-operational position, said leas into the open, use position to rest respective lower ends of said leas on the ground, and said second crosspiece into an operational rocker position wherein a lower surface of said second stiffening crosspiece rests on the ground to provide the operational rocker position.

* * * * *